US007959853B2

(12) United States Patent
Payne

(10) Patent No.: US 7,959,853 B2
(45) Date of Patent: Jun. 14, 2011

(54) STOPPER ROD

(75) Inventor: Mark A. Payne, East Yorkshire (GB)

(73) Assignee: Refractory Intellectual Property GmbH & Co. KG, Wienerbergstrabe (AT)

( * ) Notice: Subject to any disclaimer, the term of this patent is extended or adjusted under 35 U.S.C. 154(b) by 795 days.

(21) Appl. No.: 11/918,742

(22) PCT Filed: Mar. 13, 2006

(86) PCT No.: PCT/GB2006/000884

§ 371 (c)(1),
(2), (4) Date: Nov. 21, 2007

(87) PCT Pub. No.: WO2006/111694

PCT Pub. Date: Oct. 26, 2006

(65) Prior Publication Data

US 2009/0277932 A1 Nov. 12, 2009

(30) Foreign Application Priority Data

Apr. 20, 2005 (GB) ..... 0507939.7

(51) Int. Cl.
*B22D 41/18* (2006.01)

(52) U.S. Cl. ..... 266/236; 222/602

(58) Field of Classification Search ..... 266/236; 222/602

See application file for complete search history.

(56) References Cited

U.S. PATENT DOCUMENTS 5,024,422 A * 6/1991 Fishler et al. ..... 266/272
5,303,905 A * 4/1994 Pohl et al. ..... 222/602
5,681,497 A * 10/1997 Labod ..... 222/590
6,026,997 A * 2/2000 Kremer et al. ..... 222/602
6,464,116 B1 * 10/2002 Hanse ..... 222/602

OTHER PUBLICATIONS

Patent Abstracts of Japan, vol. 006, No. 033 (M-114), Feb. 27, 1982 & JP 56 148452 A (Nippon Kokan KK <NKK>), Nov. 17, 1981 (abstract).

* cited by examiner

*Primary Examiner* — Scott Kastler
(74) *Attorney, Agent, or Firm* — Nixon & Vanderhye

(57) ABSTRACT

Stopper rod having an elongated body of refractory material, a passageway extending longitudinally in the body from an end thereof which is uppermost in use, a carrier rod having a part fixedly received in the passageway and a further part outside of the passageway for attachment to a lifting device for the stopper rod. The passageway has an enlarged part which defines a sealing surface spaced from the end of the body, an insert around the carrier rod having at least a part thereof received in the enlarged part, a retention element on the carrier rod, and an expandable element disposed between the insert and the retention element. The material of the insert has a co-efficient of thermal expansion no greater than that of the carrier rod. Expansion of the expandable element, in use, is greater than that of the carrier rod.

13 Claims, 3 Drawing Sheets

STOPPER ROD

This application is the U.S. National Phase of International Application PCT/GB2006/000884, filed 13 Mar. 2006, which designated the U.S. PCT/GB2006/000884 claims priority to British Application No. 0507939.7 filed 20 Apr. 2005. The entire content of these applications are incorporated herein by reference.

BACKGROUND OF THE INVENTION

This invention relates to a stopper rod for controlling the flow of molten metal from a ladle or a tundish.

As is well known, stopper rods used in the casting of molten metals are connected, in use, by a metallic carrier rod to a lifting device which is arranged to move the stopper rod in the direction of its longitudinal axis so as to control flow of molten material through an outlet in the vessel in which the stopper rod is received. It is also well known to provide the carrier rod with a gas channel for introducing inert gas into the stopper rod. The extreme conditions under which the stopper rod operates in use make it difficult to ensure that the stopper rod is always securely connected to the carrier rod when the temperature increases, and to ensure that there is gas tightness so that there is no significant loss of inert gas and no penetration of atmospheric air into the stopper rod, the latter causing oxidation of the molten metal and lowering the quality of the final product.

DE4444617A1 and EP1140393 both address the above mentioned problems, amongst others, and each discloses the use of a cylindrical insert or sleeve disposed around the carrier rod to compensate for the effect of expansion of the carrier rod.

SUMMARY OF THE INVENTION

An object of the invention is to provide an improved stopper rod with means for compensating for expansion of the carrier rod thereof.

According to the present invention, there is provided a stopper rod comprising an elongated body of refractory material, a passageway extending longitudinally in the body from an end thereof which is uppermost in use, a carrier rod having a part fixedly received in said passageway and a further part outside of the passageway for attachment, in use, to a lifting device for the stopper rod, the passageway having an enlarged part which defines a sealing surface spaced from said end of the body, an insert around the carrier rod having at least a part thereof received in said enlarged part, retention means on the carrier rod, characterised by expandable means being disposed between the insert and said retention means, by the material of the insert having a coefficient of thermal expansion no greater than that of the carrier rod, and by expansion of said expandable means, in use, being greater than that of the carrier rod.

Preferably the expandable means comprises two washers between which is disposed an expandable graphitic composition. More preferably the expandable graphitic composition has been pre-heated prior to being disposed between two said washers to remove some but not all of its interstitial water therefrom. Most preferably the washers are glued to the graphitic composition.

In an alternative embodiment, the expandable means comprises a recessed washer within which a standard washer can slide, an expandable graphitic composition being disposed in between the washers. Desirably the expandable graphite composition has been pre-heated prior to being disposed between said washers, to remove some by not all of its interstitial water therefrom.

Conveniently the insert compresses a seal seated on said sealing surface, the surface and the seal preferably being annular.

Advantageously the retention means comprise a washer, against which the expandable means engage, and a nut which is engaged on threads on the carrier rod and tightened, in use, to effect engagement of the washer with said expandable means.

BRIEF DESCRIPTION OF THE DRAWINGS

The invention will now be described, by way of example, with reference to the accompanying drawings, in which.

DETAILED DESCRIPTION OF PREFERRED

Figure 1:
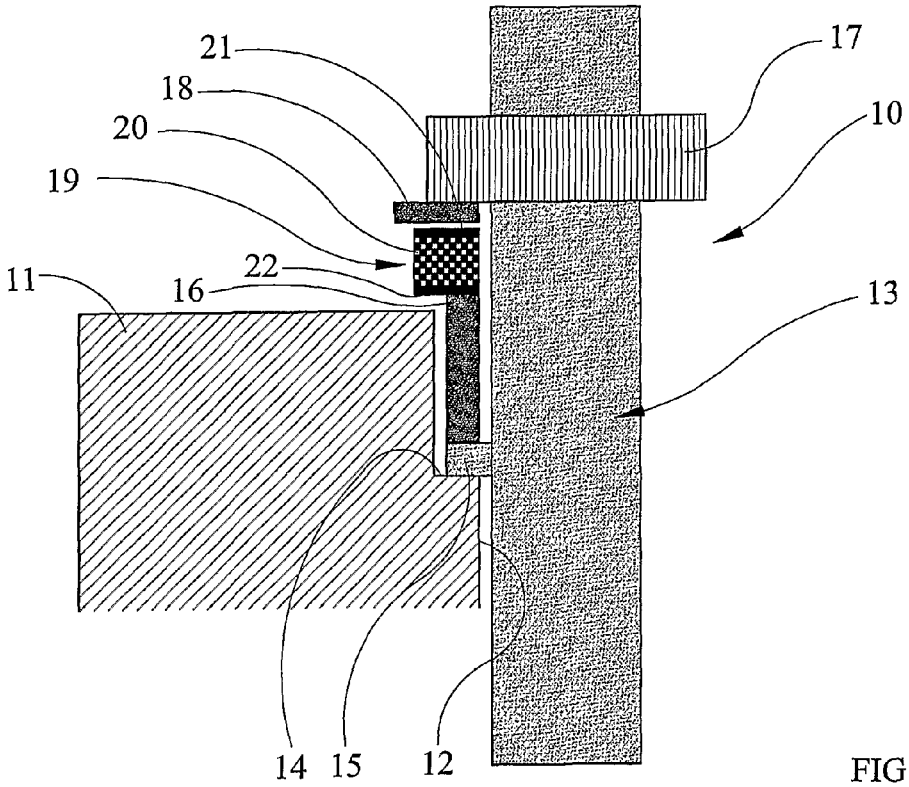
FIG. 1 is a schematic fragmentary cross-section of an upper end of a stopper rod of the invention.

The stopper rod 10 shown schematically in FIG. 1 has various components thereof of known form. It comprises a refractory material elongated body 11 through which extends longitudinally a central axial passageway 12 from the end of the body which is uppermost in use. Received in the passageway is a lower part of a metallic carrier rod 13. The rod 13 is fixed to the body in said bore by any suitable means, for example by a cross-pin as in DE4040189, or a pressed-in internally threaded insert as in EP1140393. The carrier rod 13 may have an axial passageway extending centrally therethrough for supplying inert gas into the passageway 12 and the lower end of the body 11 may be provided with means for introducing such inert gas into the vessel in which the stopper rod is disposed, in use.

At its upper end outside of the body 11, the carrier rod is adapted to be connected to a lifting mechanism for raising and lowering the stopper rod in the vessel in which it is disposed.

Inwards of its upper end the passageway 12 is radially enlarged, so that at the bottom of the enlarged part is an annular step defiling a flat sealing surface 14 spaced from the top end of the body. Carried on this surface 14 is an annular graphical seal or gasket 15, which is provided to prevent infiltration of air and loss of inert gas, if provided. A hollow cylindrical metal insert or sleeve 16 is fitted around the carrier rod 13 and bears on the seal 15 to maintain it under compression. An upper part of the insert 16 projects above the top of the body.

At its upper end, outside of the passageway 12, the carrier rod 13 threadedly receives thereon a nut 17 which beneath it retains a plain washer 18 received on the carrier rod, the nut 17 and washer 18 forming retention means to block the component within the enlarged part, i.e. insert 16, and also an annular expandable spring element 19 which bears on the upper annular surface of the insert 16 and against the undersurface of the washer 18.

The element 19 comprises an expandable graphitic composition 20 constrained between two plain flat annular washers 21,22. The washers are preferably glued to the respective opposite faces of the composition. As described in our co-pending British Patent Application No. 0507940.5 (Our Ref M073252PGB), the expandable graphite composition 20 is produced by first heating an expandable graphite formulation to remove it from a proportion of the interstitial water therein. Preferably 40% to 60% of the interstitial water is removed from the intumescent formulation by heating for approximately 30 minutes at approximately between 230° C. to 280° C. After this heat treatment the graphitic composition has the washers secured to it so that it is constrained therebetween.

The metal sleeve or insert 16 is of material which has a coefficient of thermal expansion no greater than, and preferably equal to, that of the carrier rod 13, whilst the pre-treated graphitic composition of the spring element 19 is arranged to expand to a greater degree than the carrier rod 13. Desirably the rod 13 and insert 16 would be of the same material, so that there is no differential expansion therebetween.

It is believed that the expanding spring element is particularly advantageous in compensating, in use, for the thermal expansion of the carrier rod, and has a much greater expansion capability that the sleeve of the prior art stopper rod of EP1140393B with a higher expansion than the carrier rod. This is a benefit to a customer in providing greater capacity to accommodate larger variations in the system due to the higher linear expansion and/or variations in dimensional accuracy, and may exert greater pressure on the seal 15.

Figure 2:
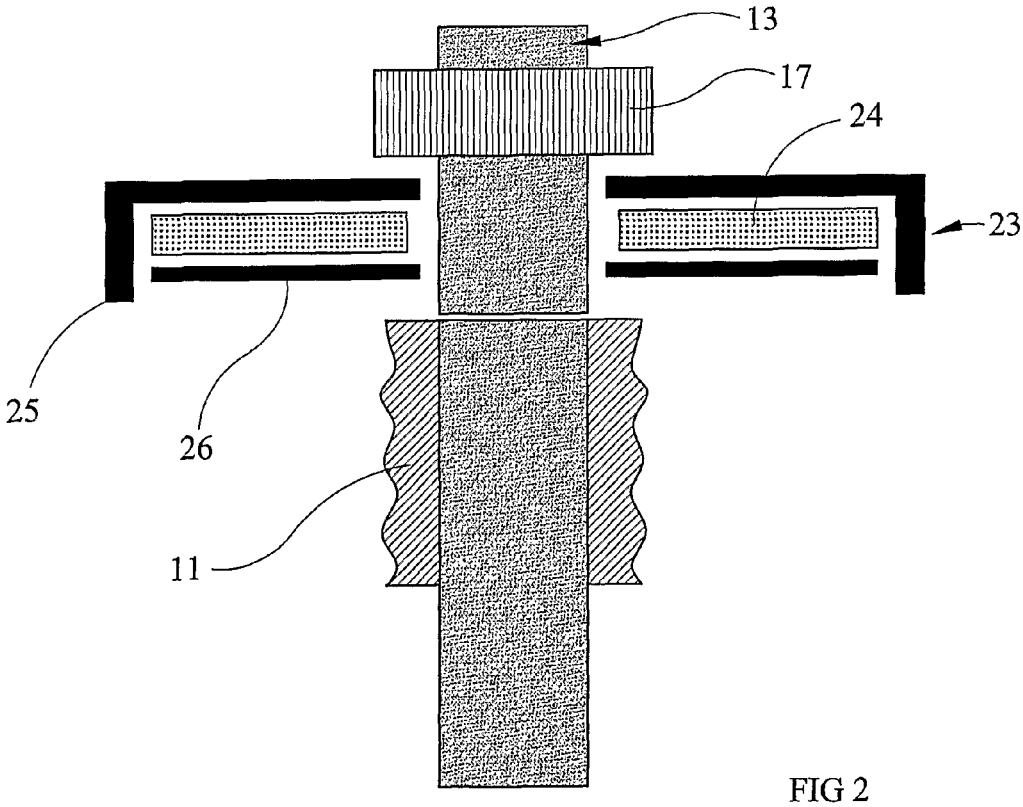
FIG. 2 is a similar view of an alternative embodiment of a stopper rod.

The alternative expandable spring element 23 shown in FIG. 2 is similar to the spring element 19 of FIG. 1, in that it comprises, in a constrained form between two washers, a graphitic composition 24 which has been pre-treated to remove a percentage of interstitial water from an initial expandable graphite formulation in the same manner as described for the composition 20.

Instead of plain washers 21, 22, the FIG. 2 spring element 23 has an upper recessed washer 25 within which a standard flat washer 26 is arranged to slide freely up and down as the composition 24 expands (and contracts). The washers could again be attached to the composition by any suitable means, for example by gluing. The spring element 23 expands relatively more than the carrier rod 13 and thus, as with the FIG. 1 embodiment ensures sealing and gas tightness.

Figure 3:
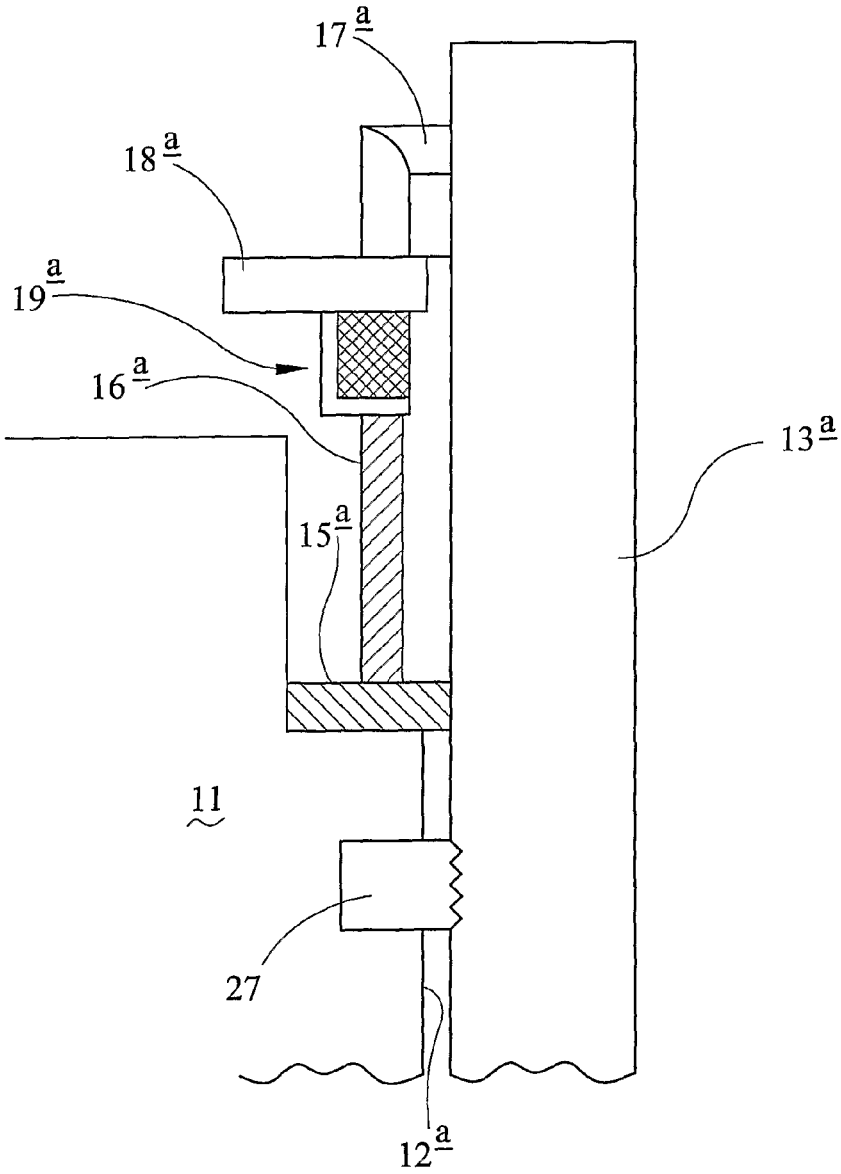
FIG. 3 is a view like FIG. 1 of a still further alternative embodiment.
Figure 4:
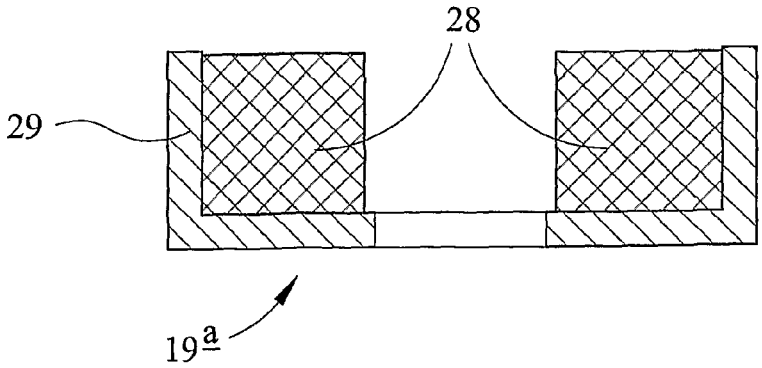
FIG. 4 is a cross-sectional view of a further alternative form of expandable element, as used in the FIG. 3 embodiment.

The stopper rod shown in FIG. 3 is like the stopper rod of FIG. 1, with like parts being numbered as in FIG. 1, but with the addition of suffix 'a'. The Figure shows a standard nut 17*a* engaging a standard washer 18*a*, which itself engages the open top of an expandable spring element 19*a*. The lower surface of the element 19*a* abuts the top of a metal sleeve 16*a*, the lower end of which bears on the upper surface of a standard graphoil seal 15*a*. In this embodiment there is a ceramic nut 27 pressed into the stopper body and engaging the rod 13*a*. As shown best in FIG. 4, the element 19*a* is formed with the graphite composition 28 held within a pressed metal cup 29, preferably by gluing. This ensures that it will not be crushed during stopper assembly and tightening of the nut 17*a* etc. Also the element 19*a* must not deform in preference to the seal 15*a*, otherwise it will not be gas tight whilst cold. The cup 29 may also offer some protection against oxidation of the composition. The composition 28 could be cast or pressed into the cup 29 and supplied as a single unit.

Figure 5:
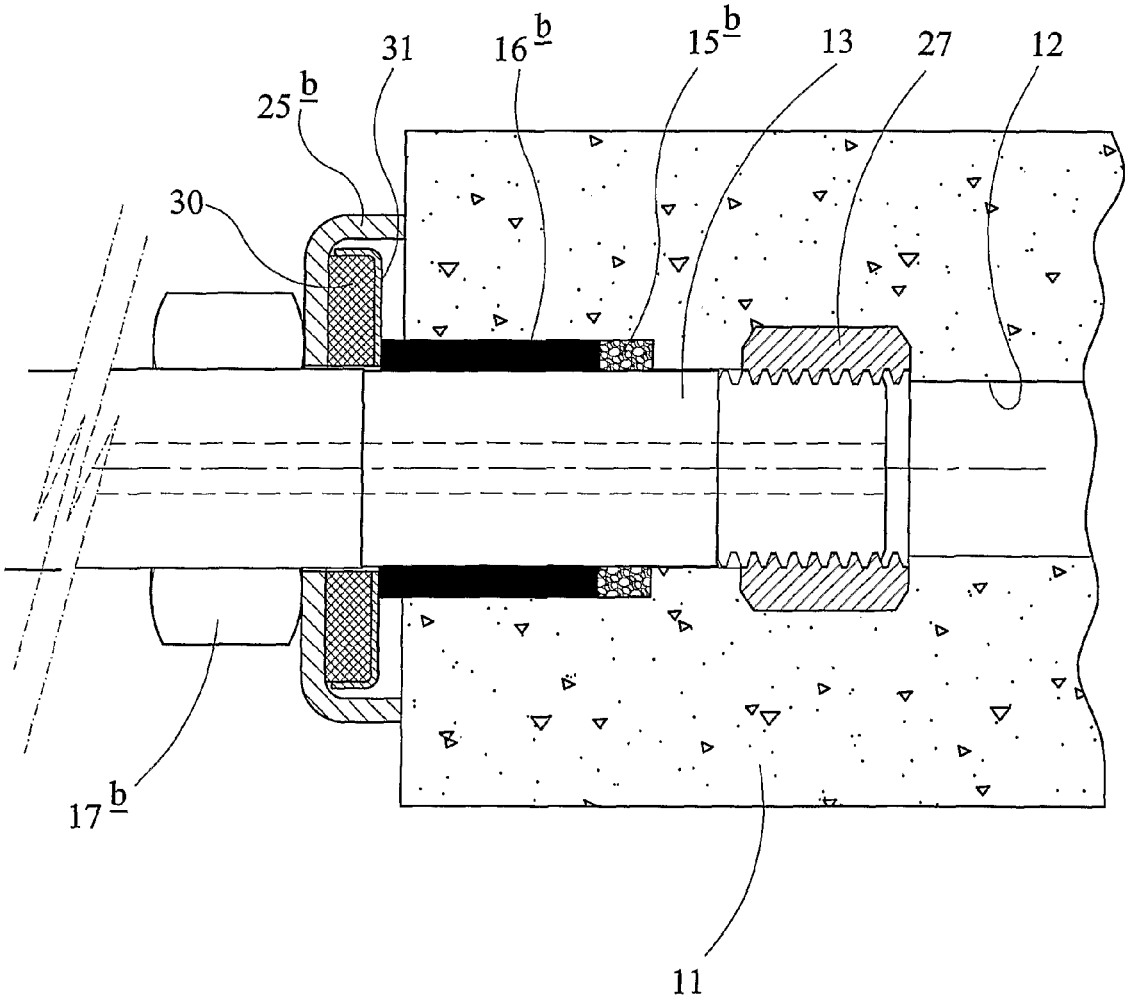
FIG. 5 is a cross-sectional view of a still further alternative embodiment.

FIG. 5 shows a further embodiment of a stopper rod of the invention which has features in common with both of the FIG. 2 and FIG. 3 embodiments. Accordingly like, but modified, parts will be numbered as for those Figures, but with the suffix 'b'.

Shown in FIG. 5 is a body 11 having carrier rod 13 fixed thereto by a ceramic nut 27 pressed into the stopper body at a position inwards of the radially enlarged part of the stopper rod passageway 12. In said radially enlarged part is a graphoil seal 15*b* and a metal (preferably steel) collar 16*b*, which bears upon the seal and projects beyond the adjacent open end of the stopper rod body.

Outside of the stopper rod body, the carrier rod is threadedly engaged by a nut 17*b* engaging a metallic cup washer 25*b*, which bears against the end (top) surface of the stopper rod body. Within the washer 25*b* is disposed an expandable graphitic composition 30, of the same form as compositions 20 and 24. The composition is held, preferably by gluing, within a metal jacket 31, which is open where it faces the washer 25*b*. The composition extends beyond said open part of the jacket and engages the inner surface of the washer 25*b*. The outer surface of the base of the jacket 31 engages the end of the collar 16*b* extending out of the stopper rod body.

The invention claimed is:

1. A stopper rod comprising:

an elongated body of refractory material, a passageway extending longitudinally in the body from an end thereof which is uppermost, in use, a carrier rod having a part fixedly received in said passageway and a further part outside of the passageway for attachment, in use, to a lifting device for the stopper rod, the passageway having an enlarged part which defines a sealing surface spaced from said end of the body, an insert around the carrier rod having at least a part thereof received in said enlarged part, a retention element on the carrier rod, an expandable element being disposed between the insert and said retention element, the material of the insert having a co-efficient of thermal expansion no greater than that of the carrier rod, and expansion of said expandable element, in use, being greater than that of the carrier rod.

2. A stopper rod as claimed in claim 1, wherein the expandable element comprises two washers between which is disposed an expandable graphitic composition.

3. A stopper rod as claimed in claim 2, wherein the washers are glued to the graphitic composition.

4. A stopper rod as claimed in claim 1, wherein the expandable element comprises a recessed washer within which a standard washer can slide, an expandable graphitic composition being disposed between the washers.

5. A stopper rod as claimed in claim 4, wherein the washers are glued to the graphitic composition.

6. A stopper rod as claimed in claim 1, wherein the expandable element comprises an expandable graphitic composition held within a metal cup, an open end of the cup engaging a plain washer of the retention element, and a closed end of the cup engaging said insert.

7. A stopper rod as claimed in claim 6, wherein the expandable element is held within said cup by gluing.

8. A stopper rod as claimed in claim 1, wherein the expandable element comprises an expandable graphitic composition held within a metal jacket, an open end of which engages the inner surface of a cup washer, an open end of the cup washer engaging said end of the stopper rod body, and a closed end of the jacket engaging said insert.

9. A stopper rod as claimed in claim 8, wherein the expandable element is held in said jacket by gluing.

10. A stopper rod as claimed in claim 1, wherein said expandable element comprises an expandable graphitic composition that has been pre-heated prior to forming part of said expandable element, to remove some but not all of its interstitial water therefrom.

11. A stopper rod as claimed in claim 1, wherein the insert compresses a seal seated on said sealing surface.

12. A stopper rod as claimed in claim 11, wherein said seal and said sealing surface are annular.

13. A stopper rod as claimed in claim 1, wherein the retention element comprises a washer, against which the expandable element engages, and a nut which is engaged on threads on the carrier rod and tightened, in use, to effect engagement of the washer with said expandable element.

* * * * *